US009945273B2

(12) United States Patent
Choi

(10) Patent No.: US 9,945,273 B2
(45) Date of Patent: Apr. 17, 2018

(54) MULTIPLE VARIABLE VALVE LIFT APPARATUS

(71) Applicant: HYUNDAI MOTOR COMPANY, Seoul (KR)

(72) Inventor: Byong Young Choi, Bucheon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 112 days.

(21) Appl. No.: 15/244,595

(22) Filed: Aug. 23, 2016

(65) Prior Publication Data

US 2017/0152773 A1 Jun. 1, 2017

(30) Foreign Application Priority Data

Nov. 27, 2015 (KR) ..... 10-2015-0167963

(51) Int. Cl.

| | |
|---|---|
| ***F01L 1/46*** | (2006.01) |
| ***F01L 13/00*** | (2006.01) |
| ***F01L 1/26*** | (2006.01) |
| *F01L 1/344* | (2006.01) |
| *F01L 1/047* | (2006.01) |

(52) U.S. Cl.

CPC ..... *F01L 13/0042* (2013.01); *F01L 1/047* (2013.01); *F01L 1/267* (2013.01); *F01L 13/0036* (2013.01); *F01L 1/34413* (2013.01); *F01L 2001/0473* (2013.01); *F01L 2013/0052* (2013.01)

(58) Field of Classification Search

CPC ..... F01L 2001/0473; F01L 1/34413; F01L 13/0042; F01L 2013/0052

USPC ..... 123/90.18

See application file for complete search history.

(56) References Cited

U.S. PATENT DOCUMENTS

| | | | | |
|---|---|---|---|---|
| 2011/0226205 | A1* | 9/2011 | Kraus | F01L 1/047 123/90.18 |
| 2014/0102389 | A1* | 4/2014 | Stolk | F01L 13/0036 123/90.15 |
| 2014/0182531 | A1* | 7/2014 | Choi | F01L 1/34 123/90.15 |

(Continued)

FOREIGN PATENT DOCUMENTS

| | | |
|---|---|---|
| JP | 2010-520394 A | 6/2010 |
| JP | 2010-520395 A | 6/2010 |

(Continued)

*Primary Examiner* — Jorge Leon, Jr.

(74) *Attorney, Agent, or Firm* — McDermott Will & Emery LLP

(57) ABSTRACT

A multiple variable valve lift apparatus includes a first moving cam, the first moving cam provided to rotate together with the camshaft and move in an axial direction of the camshaft, a plurality of cams realizing different valve lifts relative to each other, a second moving cam provided to rotate together with the camshaft and move in an axial direction of the camshaft, and forming a second cam guide protrusion and a plurality of cams realizing different valve lifts relative to each other, a first operating unit, a second operating unit, a controller, and a valve opening/closing unit, wherein at least two pins are respectively disposed at the first operating unit and the second operating unit so as to guide the first cam guide protrusion and the second cam guide protrusion, and an interference preventing pin formed to have a relatively large diameter in comparison with the other pin.

6 Claims, 5 Drawing Sheets

(56) References Cited

U.S. PATENT DOCUMENTS

| | | | | |
|---|---|---|---|---|
| 2014/0303873 | A1* | 10/2014 | Glugla | F01L 13/0036 701/103 |
| 2015/0047589 | A1* | 2/2015 | Moran | F01L 13/0036 123/90.18 |
| 2015/0107540 | A1* | 4/2015 | Moon | F01L 13/0036 123/90.15 |
| 2015/0233271 | A1* | 8/2015 | Popp | F01L 13/0036 123/90.18 |

FOREIGN PATENT DOCUMENTS

| | | | |
|---|---|---|---|
| KR | 10-2014-0087368 | A | 7/2014 |
| WO | 2012/146361 | A1 | 11/2012 |

* cited by examiner

MULTIPLE VARIABLE VALVE LIFT APPARATUS

CROSS-REFERENCE TO RELATED APPLICATION

This application claims the benefit of priority to Korean Patent Application No. 10-2015-0167963, filed with the Korean Intellectual Property Office on Nov. 27, 2015, the entire contents of which are incorporated herein by reference.

TECHNICAL FIELD

The present disclosure relates to a multiple variable valve lift apparatus. More particularly, the present disclosure relates to a multiple variable valve lift apparatus which realizes multiple valve lift using a simple structure.

BACKGROUND

Generally, an internal combustion engine receives fuel and air into a combustion chamber and generates power by combusting the fuel and the air. An intake valve is operated by a camshaft, and air flows into the combustion chamber while the intake valve is open. In addition, an exhaust valve is operated a camshaft, and air is exhausted from the combustion chamber while the exhaust valve is open.

Optimal operation of the intake valve/exhaust valve, however, depends on the RPM of the engine. That is, an appropriate time for lifting or opening/closing the valves depends on the RPM of the engine. In order to implement an appropriate valve operation in accordance with the RPM of the engine, as described above, a VVL (Variable Valve Lift) apparatus that operates valves at different lifts in accordance with the RPM of an engine has been studied and employed.

Meanwhile, in a variable valve lift apparatus having a cam shift type which is configured that a plurality of cams are designed for driving a valve and the plurality of cams is moved along an axial direction, it is important that relative position between the plurality of cams and a valve opening/closing unit is exactly controlled.

In a case that relative position between the plurality of cams and a valve opening/closing unit is not exactly controlled, interference may occur between elements for guiding axial direction motion of the plurality of cams and the valve opening/closing unit or between the plurality of cams and the valve opening/closing unit. Thus, the valve opening/closing unit or the variable valve lift apparatus may be damaged, or reliability of a cam shift may be deteriorated.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a multiple variable valve lift apparatus having advantages of preventing interference between constituent elements and improving reliability of a cam shift.

A multiple variable valve lift apparatus according to an exemplary embodiment of the present disclosure may include: a first moving cam formed in a hollow cylindrical shape into which a camshaft is inserted, the first moving cam provided to rotate together with the camshaft and move in an axial direction of the camshaft, and configured to form a first cam guide protrusion and a plurality of cams realizing different valve lifts relative to each other; a second moving cam formed in a hollow cylindrical shape into which a camshaft is inserted, the second moving cam provided to rotate together with the camshaft and move in an axial direction of the camshaft, and configured to form a second cam guide protrusion and a plurality of cams realizing different valve lifts relative to each other; a first operating unit for selectively guiding the first cam guide protrusion so as to move the first moving cam in a first direction; a second operating unit for selectively guiding the second cam guide protrusion so as to move the second moving cam in a second direction; a controller for controlling operations of the first operating unit and the second operating unit; and a valve opening/closing unit for contacting with any one cam of the plurality of cams so as to open/close a valve.

At least two pins may be respectively disposed at the first operating unit and the second operating unit so as to guide the first cam guide protrusion and the second cam guide protrusion, and an interference preventing pin, which may be one of the pins, may be formed to have a relatively large diameter in comparison with the other pin.

The first cam guide protrusion and the second cam guide protrusion may be formed in opposite directions in order to move the first moving cam and the second moving cam in a first direction and a second direction, respectively.

The first moving cam and the second moving cam may move together.

The first and second operating unit may include first and second solenoids actuated under control of the controller.

The first and second cam guide protrusions may be inserted between the pins so as to be guided when the pin is jutted by the first and second solenoids.

The at least two pins may include a main pin being jutted depending on operations of the first and second solenoid and at least one subordinate pin being engaged to the main pin so as to be jutted together with the main pin At the first operating unit which is operated for moving the first moving cam in a first direction, a subordinate pin being disposed at a last position along a second direction with respect to the main may be the interference preventing pin, and at the second operating unit which is operated for moving the second moving cam in the second direction, a subordinate pin being disposed at a last position along the first direction with respect to the main may be the interference preventing pin.

A gap between the main pin and the interference preventing pin may be formed to be equal to a gap between the other pins.

DETAILED DESCRIPTION

An exemplary embodiment of the present disclosure will hereinafter be described in detail with reference to the accompanying drawings.

Figure 1:
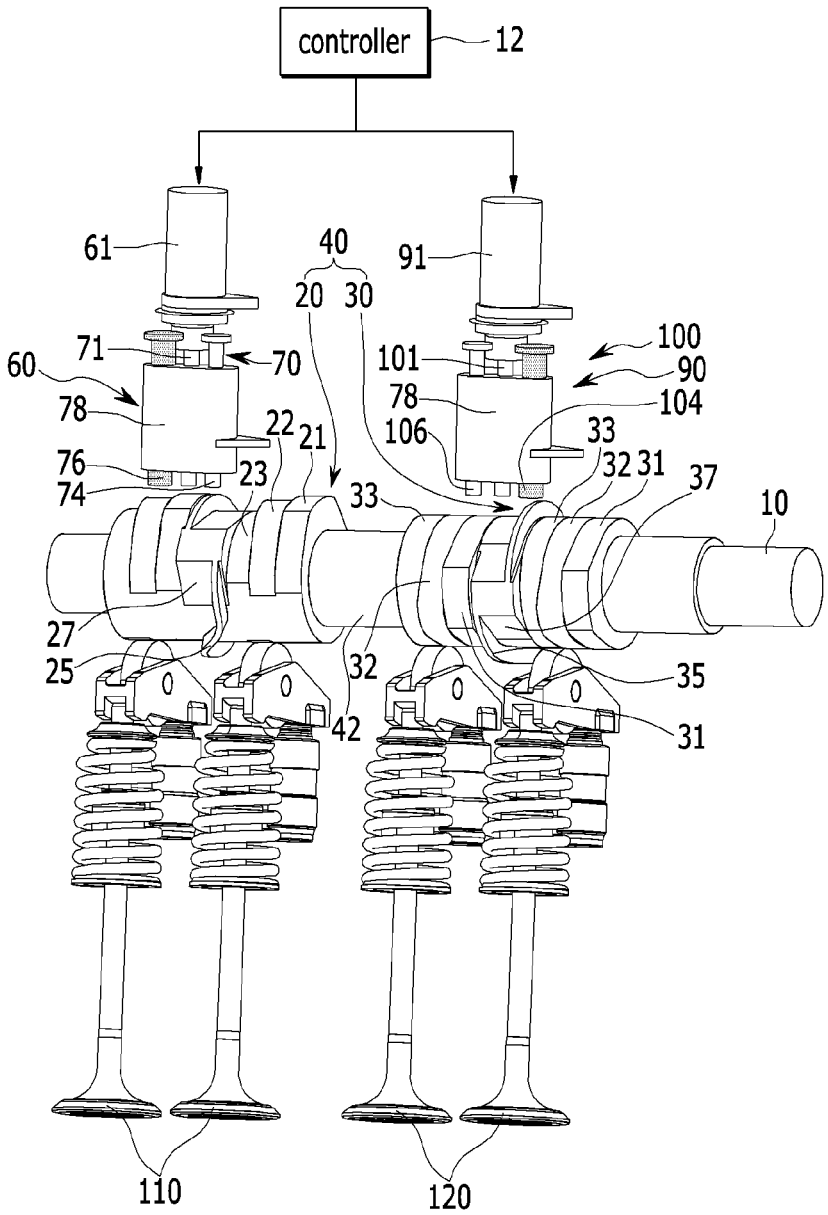
FIG. 1 is a perspective view of a multiple variable valve lift apparatus according to an exemplary embodiment of the present disclosure.

FIG. 1 is a perspective view of a multiple variable valve lift apparatus according to an exemplary embodiment of the present disclosure.

As shown in FIG. 1, a multiple variable valve lift apparatus according to an exemplary embodiment of the present disclosure may include a camshaft 10, a first moving cam 20 including a plurality of cams 21, 22, and 23 having different shapes, having a first cam guide protrusion 25, rotating together with the camshaft 10, and being slidable in an axial direction of the camshaft 10, a second moving cam 30 including a plurality of cams 31, 32, and 33 having different shapes, having a second cam guide protrusion 35, rotating together with the camshaft 10, and being slidable in the axial direction of the camshaft 10, a first operating unit 60 selectively jutting out to guide the first cam guide protrusion 25 to move the first moving cam 20 in a first direction, a second operating unit 90 selectively jutting out to guide the second cam guide protrusion 35 to move the second moving cam 30 in a second direction, a controller 12 configured to control operations of the first operating unit 60 and the second operating unit 90, and valve opening and closing units 110 and 120 brought into contact with any one of the plurality of cams 21, 22, 23, 31, 32, and 33 so as to be opened and closed.

The first moving cam 20 and the second moving cam 30 may include three cams 21, 22, and 23, and 31, 32, and 33, respectively, but the present disclosure is not limited thereto, and the first moving cam 20 and the second moving cam 30 may have various numbers of cams.

The plurality of cams 21, 22, 23, 31, 32, and 33 may be disposed in order, sequentially starting from a cam having the largest valve lift, and any one of the cams, for example, the cams 23 and 33 may be cylinder deactivation cams having a cam lift of 0.

The first cam guide protrusion 25 and the second cam guide protrusion 35 may be formed in opposite directions in order to move the first moving cam 20 and the second moving cam 30 in the first direction and the second direction, respectively. For example, the first cam guide protrusion 25 may move the first moving cam 20 to the left in the drawing, and the second cam guide 35 may move the second moving cam 30 to the right.

The first and second operating units 60 and 90 may include first and second solenoids 61 and 91 actuated under the control of the controller 12, and first and second guide parts 70 and 100 jutting out by the first and second solenoids 61 and 91 and allowing the first and second cam guide protrusions 25 and 35 to be inserted therein, respectively, in order to move the first and second moving cams 20 and 30.

The first and second operating units 60 and 90 further may include a pin housing 78, respectively, the first and second guide parts 70 and 100 further may include main pins 71 and 101 rotatably provided in the pin housing 78 and jutting out according to actuations of the first and second solenoids 61 and 91, and subordinate pins 74, 76, 104, and 106 rotatably provided in the pin housing 78 and engaged with the main pins 71 and 101 so as to jut out together with the main pins 71 and 101.

In FIG. 1, one main pin 71 and 101 and two subordinate pins 74, 76, 104, and 106 are provided to one pin housing 78, but the number of the main pin 71 and 101 and the subordinate pin 74, 76, 104, and 106 are not limited thereto, and the main pin 71 and 101 and the subordinate pin 74, 76, 104, and 106 may be provided in proportion to the number of the plurality of cams 21, 22, 23, 31, 32, and 33.

Sloped portions 27 and 37 may be formed in the first and second moving cams 20 and 30, respectively, to allow the first and second guide parts 70 and 100 to return to their original positions after the first and second moving cams 20 and 30 are moved.

The first moving cam 20 and the second moving cam 30 may be connected to integrally move, and the first moving cam 20 and the second moving cam 30 may be integrally formed as a single moving cam 40. That is, the first cam guide protrusion 25 and the second cam guide protrusion 35 may move the moving cam 40 in the first direction or the second direction. In addition, a journal portion 42 may be formed in a cylinder shape having a uniform radius so as to connect the first moving cam 20 with the second moving cam 30.

When the main pins 71 and 101 and the subordinate pins 74, 76, 104, and 106 jut out so the first and second cam guide protrusions 25 and 35 are inserted between the main pins 71 and 101 and the subordinate pins 74, 76, 104, and 106, the first moving cam 20 and the second moving cam 30, or the moving cam 40, move in an axial direction of the camshaft 10, the main pins 71 and 101 and the subordinate pins 74, 76, 104, and 106 may move along the sloped portions 27 and 37 so as to return to their original positions.

Figure 2:
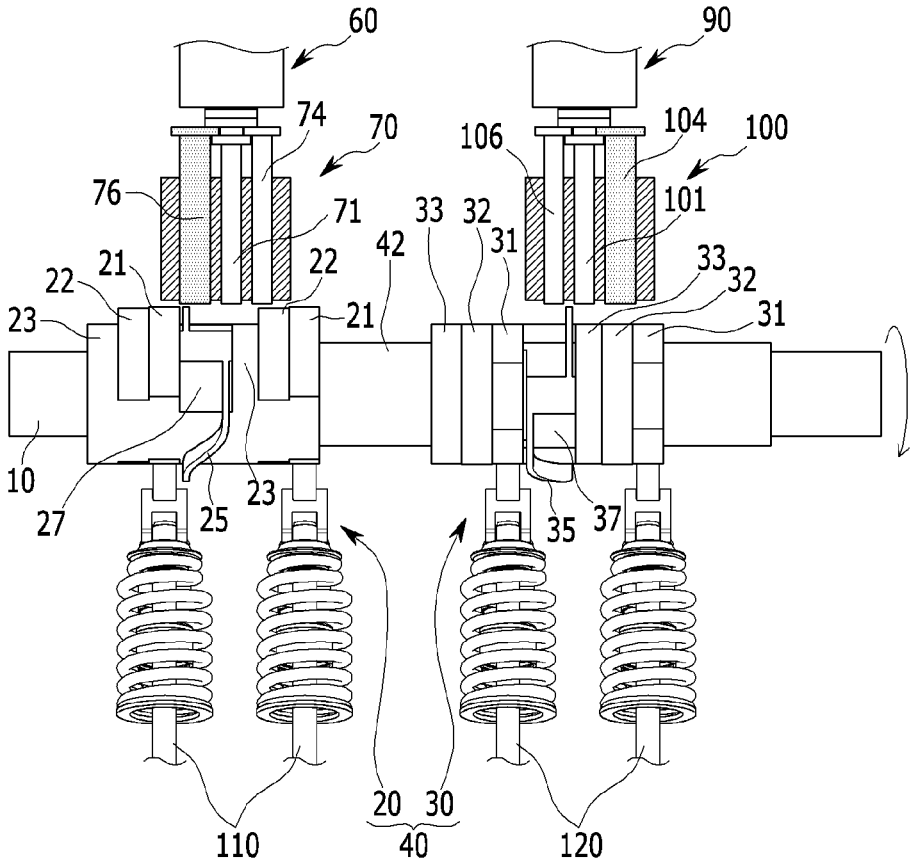
FIG. 2 to FIG. 4 are operational views of a multiple variable valve lift apparatus according to exemplary embodiments of the present disclosure.
Figure 3:
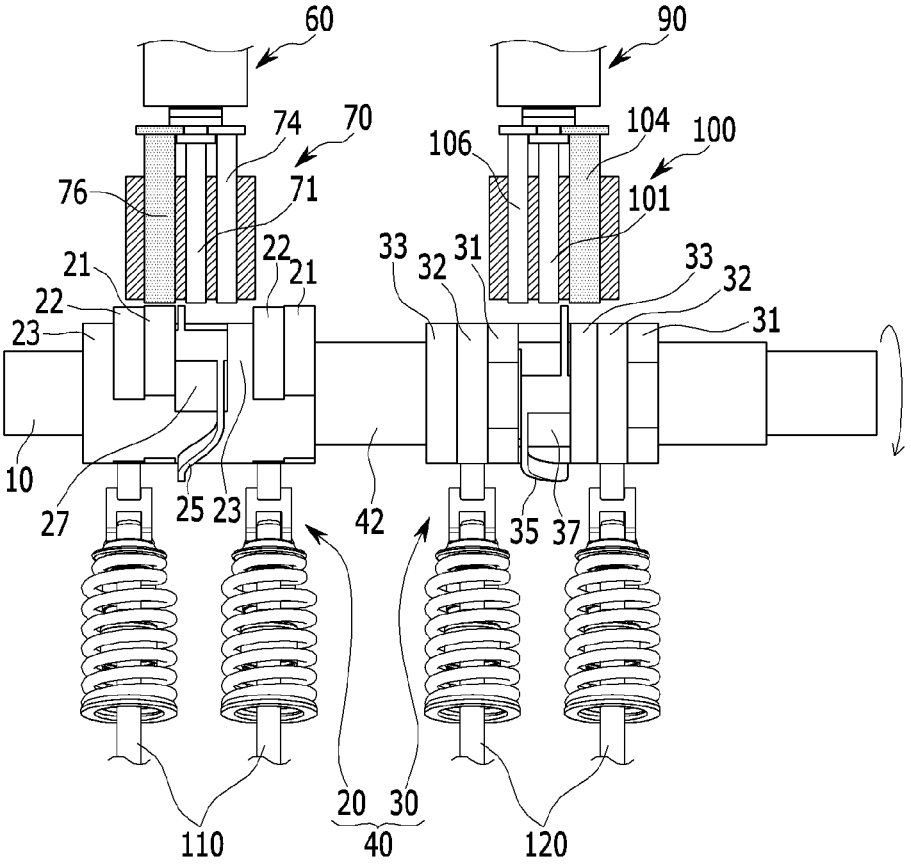
Figure 4:
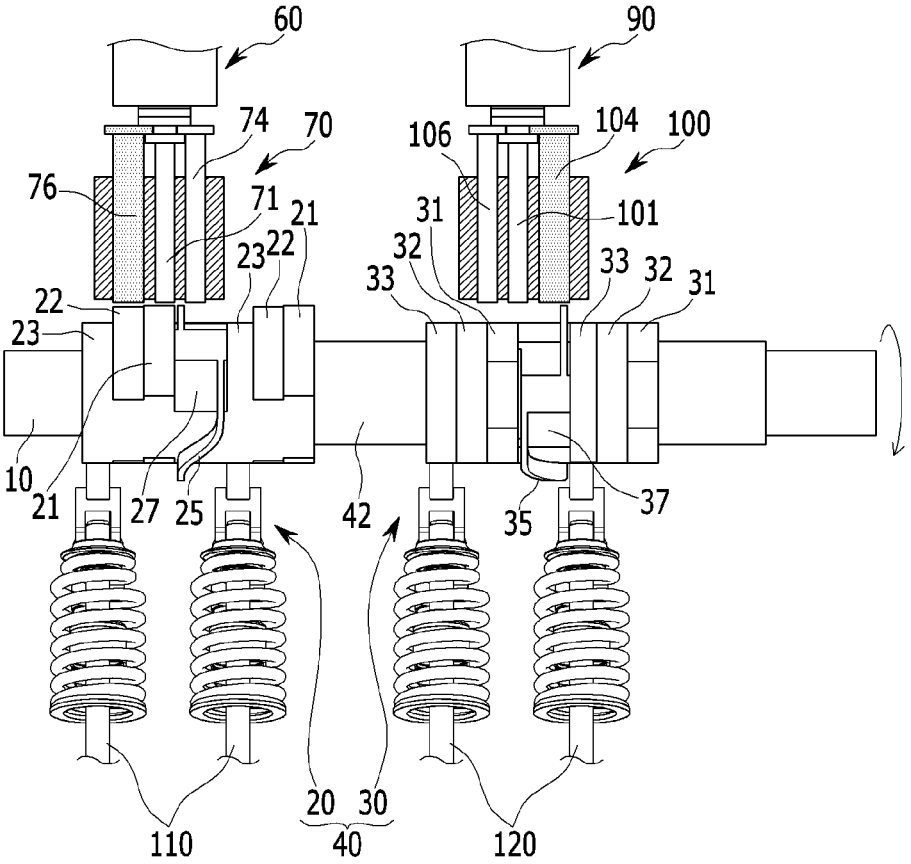

FIG. 2 to FIG. 4 are operational views of a multiple variable valve lift apparatus according to exemplary embodiments of the present disclosure.

As shown in FIG. 2, in a state in which the valve opening and closing units 110 and 120 are in contact with the right cams 21 and 31 among the cams, when a load of an engine is reduced, the controller 12 may operate the second operating unit 90 and the second guide part 100 may jut out. Thus, the second cam guide protrusion 35 may be guided on the state of being inserted between the main pin 101 and the left subordinate pin 106 of the second guide part 100. Therefore, as illustrated in FIG. 3, the second moving cam 30 and the first moving cam 20 may move toward the second direction which is the right in the drawing, and the valve opening and closing units 110 and 120 may come into contact with the middle cams 22 and 32 among the cams so as to be opened and closed. Through this process, the valve lift may be varied. Further, the second guide part 100 may return to its original position by the sloped portion 37 formed in the second moving cam 30.

In the state illustrated in FIG. 3, when the load of the engine is further reduced, the controller 12 may operate the second operating unit 90 and the second guide part 100 may jut out. Thus, the second cam guide protrusion 35 may be guided on the state of being inserted between the main pin 101 and the right subordinate pin 104 of the second guide part 100. Subsequently, as illustrated in FIG. 4, the second moving cam 30 and the first moving cam 20 once more may move toward the second direction which is the right in the drawing, and the valve opening and closing units 110 and 120 may come into contact with the left cams 23 and 33 among the cams so as to be opened and closed. Through this process, the valve lift may be varied. The second guide part 100 may return to its original position by the sloped portion 37 formed in the second moving cam 30.

In the state illustrated in FIG. 4, when the load of the engine is increased, the controller 12 may operate the first operating unit 60 and the first guide part 100 may jut out. A change of the valve lift by a movement toward the first direction of the moving cam 40 depending on the jutting of the first guide part 100 may be similar to the above described change of the valve lift by the movement toward the second direction of the moving cam 40 though the moving cam 40 is operated in a reverse moving direction, so a detailed description thereof will be omitted.

In general, a space between cams is limited, but in the multiple variable valve lift apparatus according to an exemplary embodiment of the present disclosure, the first cam guide protrusion 25 and the second cam guide protrusion 35 may have a plate shape, thus overcoming restrictions with respect to the axial directional space of the camshaft 10.

Figure 5:
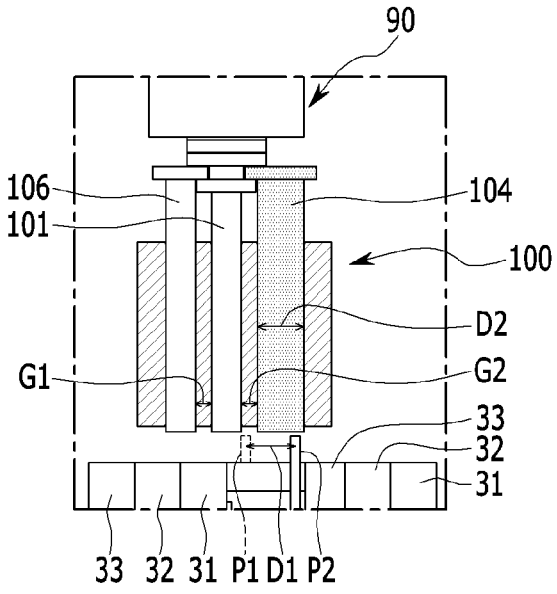
FIG. 5 is an enlarged view of an operating unit according to an exemplary embodiment of the present disclosure.

FIG. 5 is an enlarged view of an operating unit according to an exemplary embodiment of the present disclosure.

As shown in FIG. 5, one subordinate pin 76 and 104 of two subordinate pins 74, 76, 104, and 106 which are disposed at the operating unit 60 and 90 have a large width along an axial direction of the camshaft 10 in comparison with the other one subordinate pin 74 and 106 and main pin 71 and 101. Herein, the one subordinate pin 76 and 104 having the relative large width will be called "interference preventing pin 76 and 104".

The interference preventing pin 76 and 104 may be a left subordinate pin 76 of the first operating unit 60 being operated so as to move the moving cam 40 in the first direction (left in drawing) and a right subordinate pin 104 of the second operating unit 90 being operated so as to move the moving cam 40 in the second direction (right in drawing).

In a case that the first solenoid 61 and the first operating unit 60 malfunction so that the first guide part 70 is jutted in the state that the valve opening/closing unit 110 and 120 is contacted to a right cam 21 and 31 of the cams, the interference preventing pin 76 of the first operating unit 60 may be blocked to the first cam guide protrusion 25 such that the first guide part 70 is not jutted. Therefore, it may be prevented that the moving cam 40 is moved more toward the left by the first guide part 70 jutting in the state that the valve opening/closing unit 110 and 120 is contacted to the right cam 21 and 31 of the cams. Accordingly, interferences between constituent elements such as an interference between the first cam guide protrusion 25 and the valve opening/closing unit 110 may be prevented as an excessive movement of the moving cam 40 is limited.

In a case that the second solenoid 91 and the second operating unit 90 malfunction so that the second guide part 100 juts in the state that the valve opening/closing unit 110 and 120 is contacted to a left cam 23 and 33 of the cams, the interference preventing pin 104 of the second operating unit 90 may be blocked to the second cam guide protrusion 35 such that the second guide part 100 is not jutted. Therefore, it may be prevented that the moving cam 40 is moved more toward right by the second guide part 100 jutting in the state that the valve opening/closing unit 110 and 120 is contacted to the left cam 23 and 33 of the cams. Accordingly, interferences between constituent elements such as an interference between the second cam guide protrusion 35 and the valve opening/closing unit 120 may be prevented as an excessive movement of the moving cam 40 is limited.

Meanwhile, a gap G1 between the main pin 71 and 101 and the other one subordinate pin 74 and 106 may be formed to be equal to a gap G2 between the main pin 71 and 101 and the interference preventing pin 76 and 104. In addition, a distance D1 of which the cam guide protrusion 25 and 35 is moved while the valve lift is changed as one step may be shorter than a length adding the width D2 of the interference preventing pin 76 and 104 to the gap G2 between the main pin 71 and 101 and the interference preventing pin 76 and 104. In FIG. 5, the position of the cam guide protrusion 25 and 35 before moving is shown by P1, and the position thereof after moving is shown by P2.

That is, for the function of the interference preventing pin 76 and 104, the width D2 of the interference preventing pin 76 and 104 may be designed to be longer than a length subtracting the gap G2 between the main pin 71 and 101 and the interference preventing pin 76 and 104 from the moving distance D1 of the cam guide protrusion 25 and 35 during changing the valve lift as one step.

According to an exemplary embodiment of the present disclosure, multiple valve lifts can be realized by a simple composition of elements. In addition, interferences between constituent elements may be prevented and a reliability of the cam shift may be improved as the excessive movement of the moving cam 20 and 30 is limited even while the solenoid 61 and 91 and the operating unit 60 and 90 malfunction.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A multiple variable valve lift apparatus comprising:

a first moving cam formed in a hollow cylindrical shape into which a camshaft is inserted, the first moving cam provided to rotate together with the camshaft and move in an axial direction of the camshaft, and configured to form a first cam guide protrusion and a plurality of cams realizing different valve lifts relative to each other;

a second moving cam formed in a hollow cylindrical shape into which the camshaft is inserted, the second moving cam provided to rotate together with the camshaft and move in the axial direction of the camshaft, and configured to form a second cam guide protrusion and a plurality of cams realizing different valve lifts relative to each other;

a first operating unit for selectively guiding the first cam guide protrusion so as to move the first moving cam in a first direction;

a second operating unit for selectively guiding the second cam guide protrusion so as to move the second moving cam in a second direction;

a controller for controlling operations of the first operating unit and the second operating unit; and a valve opening/closing unit contacting with any one cam of the plurality of cams for opening/closing a valve, wherein at least two pins are disposed at the first operating unit so as to guide the first cam guide protrusion and at least two pins are disposed at the second operating unit so as to guide the second cam guide protrusion, and wherein one of the at least two pins at the first operating unit is an interference preventing pin formed to have a relatively large diameter in comparison with a diameter of remaining pins, and one of the at least two pins at the second operating unit is an interference preventing pin formed to have a relative large diameter in comparison with a diameter of remaining pins.

2. The apparatus of claim 1, wherein the first cam guide protrusion and the second cam guide protrusion are formed in opposite directions in order to move the first moving cam and the second moving cam in a first direction and a second direction, respectively.

3. The apparatus of claim 1, wherein the first moving cam and the second moving cam move together.

4. The apparatus of claim 1, wherein the first operating unit comprises a first solenoid actuated under control of the controller, and the first cam guide protrusion is inserted between the at least two pins so as to be guided when one of the at least two pins is jutted by the first solenoid, and the second operating unit comprises a second solenoid actuated under control of the controller, and the second cam guide protrusion is inserted between the at least two pins so as to be guided when one of the at least two pins is jutted by the second solenoid.

5. The apparatus of claim 4, wherein the at least two pins of the first operating unit comprise a main pin being jutted depending on operations of the first solenoid and at least one subordinate pin being engaged to the main pin so as to be jutted together with the main pin, and the at least two pins of the second operating unit comprise a main pin being jutted depending on operations of the second solenoid and at least one subordinate pin being engaged to the main pin so as to be jutted together with the main pin, and at the first operating unit, a subordinate pin disposed at a position on the first operating unit farthest from the second operating unit serves as the interference preventing pin, and at the second operating unit, a subordinate pin disposed at a position on the second operating unit farthest from the first operating unit is the interference preventing pin.

6. The apparatus of claim 5, wherein a gap between the main pin and the interference preventing pin is formed to be equal to a gap between remaining pins.

* * * * *